US006203645B1

(12) United States Patent
Gilpatrick

(10) Patent No.: US 6,203,645 B1
(45) Date of Patent: Mar. 20, 2001

(54) FEMALE CONNECTOR FABRIC

(75) Inventor: Michael William Gilpatrick, Chesnee, SC (US)

(73) Assignee: Milliken & Company, Spartanburg, SC (US)

( * ) Notice: Subject to any disclaimer, the term of this patent is extended or adjusted under 35 U.S.C. 154(b) by 1260 days.

(21) Appl. No.: 08/639,515

(22) Filed: Apr. 29, 1996

Related U.S. Application Data

(62) Division of application No. 08/414,136, filed on Mar. 30, 1995, now abandoned, which is a continuation of application No. 08/068,573, filed on May 24, 1993, now abandoned, which is a continuation-in-part of application No. 07/937, 305, filed on Aug. 31, 1992, now abandoned.

(51) Int. Cl.[7] ..... A44B 18/00

(52) U.S. Cl. ..... 156/166; 156/148; 156/181; 24/448; 24/445

(58) Field of Search ..... 24/442, 447, 448, 24/449, 452, 445; 156/66, 148, 178, 181

(56) References Cited

U.S. PATENT DOCUMENTS

| | | | |
|---|---|---|---|
| 3,103,098 | | 9/1963 | Dyer . |
| 3,154,837 | | 11/1964 | Mestral . |
| 3,266,841 | | 8/1966 | Altman . |
| 3,775,228 | | 11/1973 | Leary . |
| 4,202,139 | | 5/1980 | Hong et al. . |
| 4,305,245 | | 12/1981 | Eschenbach . |
| 4,307,145 | | 12/1981 | Goldman . |
| 4,366,199 | | 12/1982 | Grosjean . |
| 4,440,819 | | 4/1984 | Rosser et al. . |
| 4,519,200 | | 5/1985 | Phillips . |
| 4,571,793 | | 2/1986 | Price . |
| 4,595,438 | | 6/1986 | Kent et al. . |
| 4,761,318 | | 8/1988 | Ott et al. . |
| 4,910,064 | | 3/1990 | Sabee . |
| 5,200,246 | | 4/1993 | Sabee . |
| 5,447,590 | * | 9/1995 | Gilpatrick . |
| 5,554,239 | * | 9/1996 | Patta et al. . |

FOREIGN PATENT DOCUMENTS

| | | |
|---|---|---|
| 2234415 | 1/1975 | (FR) . |
| 923184 | 4/1963 | (GB) . |

* cited by examiner

*Primary Examiner*—Sam Chuan Yao
(74) *Attorney, Agent, or Firm*—Terry T. Moyer; Daniel R. Alexander

(57) ABSTRACT

A female fabric for use in a hook and loop connecting arrangement in which a plurality of spaced substantially parallel yarns having loops projecting from and integral therewith are held in spaced relationship by a suitable adhesive material.

5 Claims, 3 Drawing Sheets

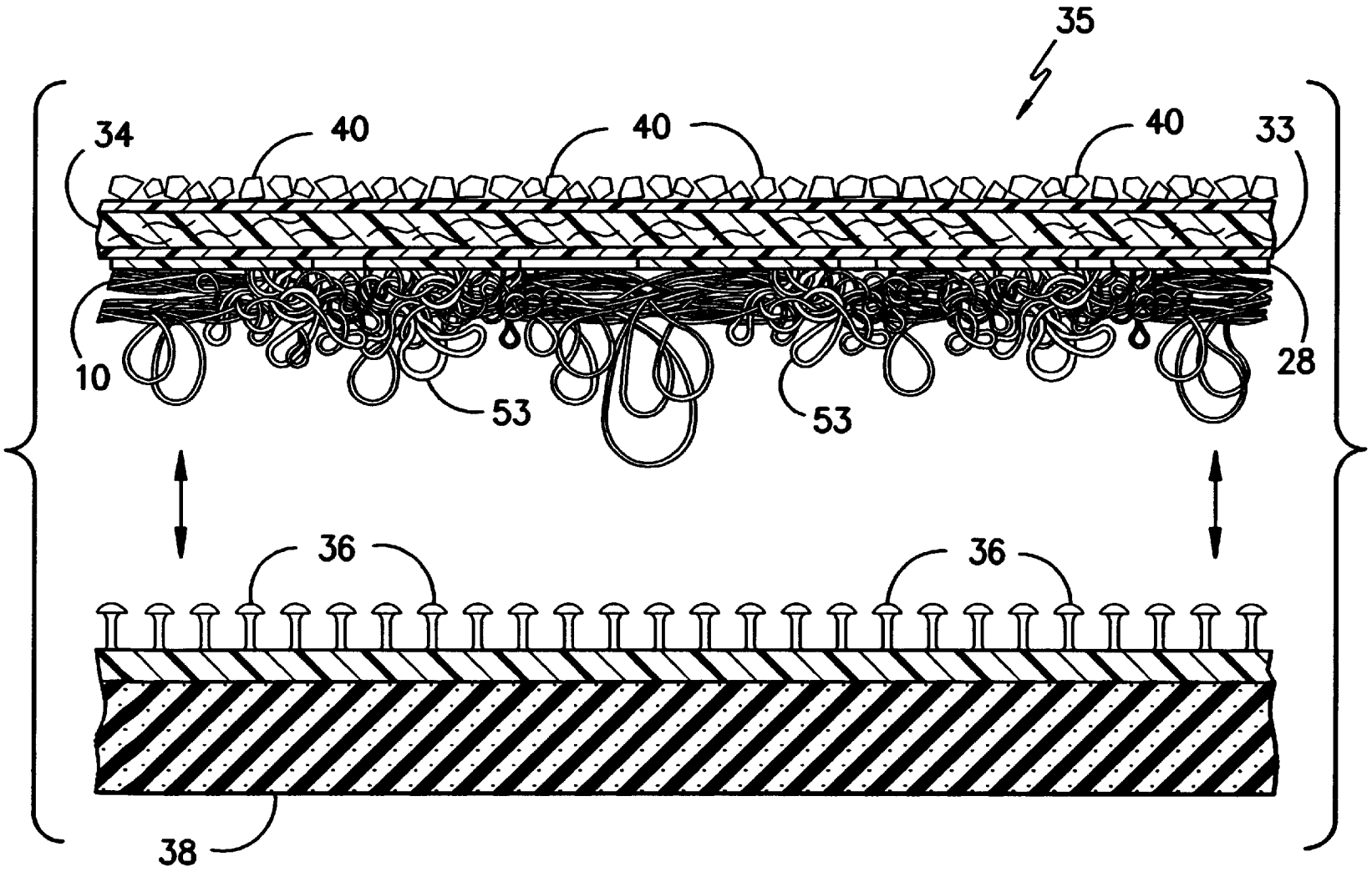
FIG. —4—

FEMALE CONNECTOR FABRIC

This is a divisional application of prior application Ser. No. 08/414,136, filed on Mar. 30, 1995, now abandoned of Michael W. Gilpatrick for FEMALE CONNECTOR FABRIC, which is a continuation application of prior application Ser. No. 08/068,573 filed on May 24, 1993, now abandoned, which is a continuation-in-part of Ser. No. 07/937,305, filed on Aug. 31, 1992, now abandoned.

This invention relates generally to a looped pile fabric and more specifically to a looped pile fabric which can be employed as the female fabric for receiving an article of manufacture in a pre-selected position in engagement with a male fabric which engages the loops of the loop pile fabric.

Therefore, it is an object of the invention to provide a loop pile fabric which is inexpensive to produce and which can be employed as a female fabric for engagement with a male connector.

Other objects and advantages of the invention will become readily apparent as the specification proceeds to describe the invention with reference to the accompanying drawings, in which:

FIG. 4 is one representation of the use of the fabric of FIG. 2.

Figure 1:
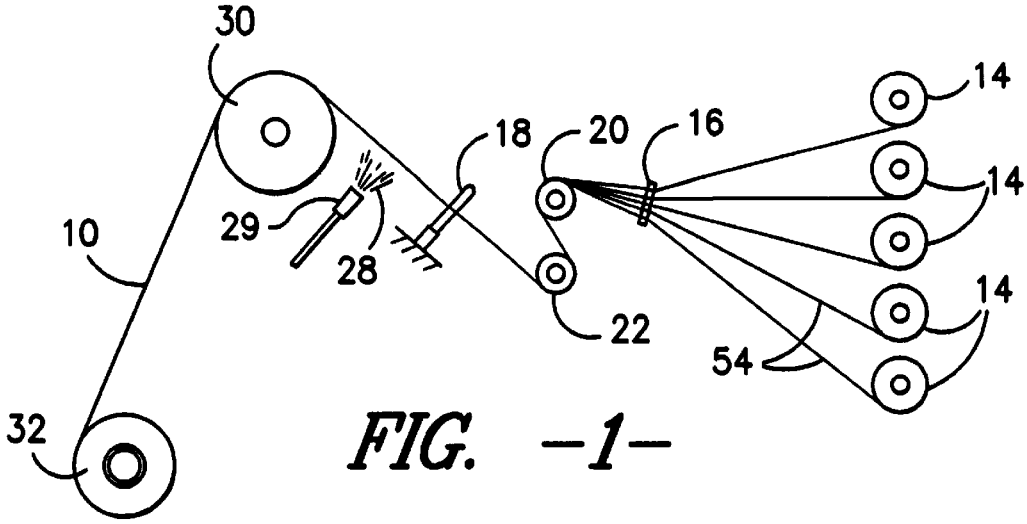
FIG. 1 is a schematic representation of one method of making the fabric shown in FIG 2.
Figure 2:
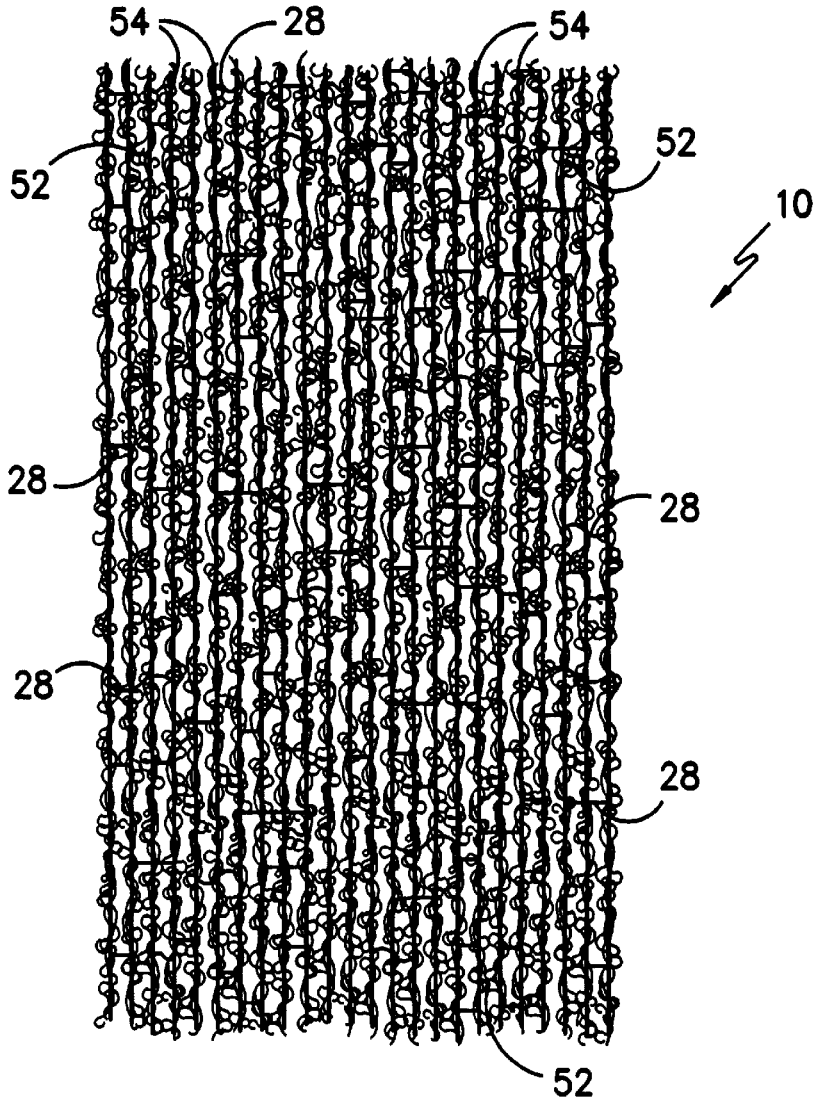
FIG. 2 is a top view of the fabric produced by the apparatus of FIG. 1.
Figure 3:
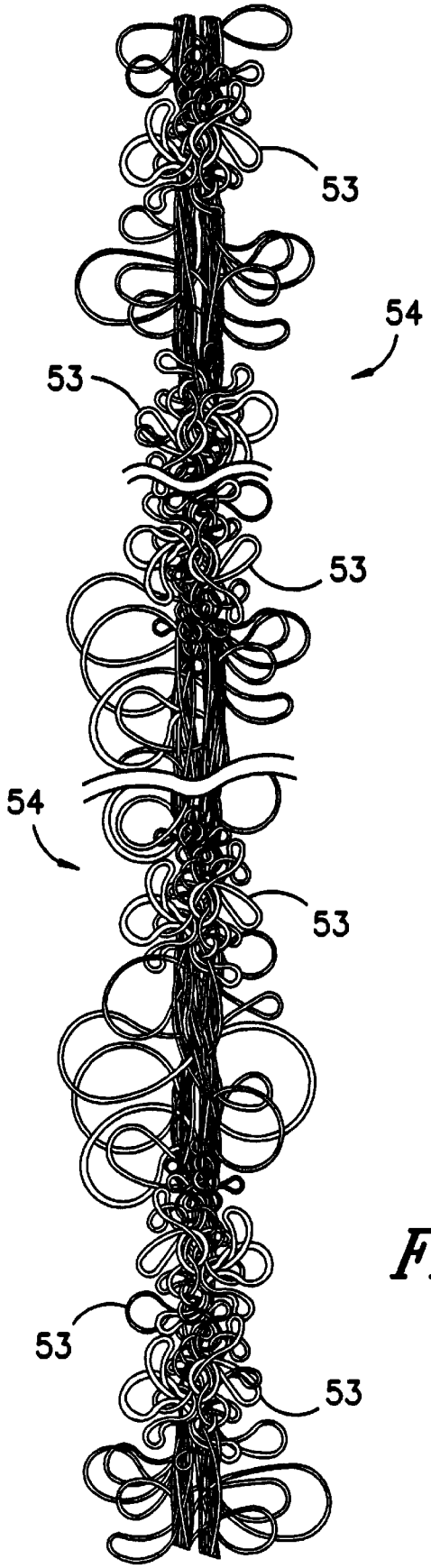
FIG. 3 is a view of one type of loop yarn used in the fabric of FIG. 2.

Looking now to the drawings, FIG. 2 shows the female fabric 10 produced by the method shown in FIG. 1. Basically the fabric 10 consists of a plurality of substantially parallel loopy yarns 54 held in spaced relationship by adhesive coated loops 53 on one yarn 54 adhering to loops 53 on adjacent yarns such as at 52 and/or adhesive 28, per se, bridging adjacent yarns 54. Whether the fabric 10 consists of adhered loops, adhesive bridging or a combination of both depends on the type of adhesive and method employed to apply the adhesive.

In the preferred form of the invention the yarn 54 consists of core and effect yarns which provide the loops 53. The core and effect yarns are 255 denier, 34 filament polyester p.o.y. yarns which are drawn to 150 denier and then supplied to a texturing air jet with the effect yarn being supplied at a rate substantially greater than the core yarn to produce a composite yarn having loops 53 of the effect yarn projecting therefrom. The rate of supply of the effect yarn is within the range of 100–200% greater than the rate of supply of the core yarn and in the preferred form of the invention is approximately 150%. Within the scope of the invention other yarns can be employed so long as the yarn has a sufficient number of loops projecting therefrom to provide a secure engagement with a mating male fabric.

The yarns 54 are taken up on bobbins or packages 14 (FIG. 1) and mounted in a creel (not shown). Depending on the width of the fabric 10 a sufficient number of packages 14 are employed to lay down the desired number of yarns 54 per inch of width of fabric 10. The yarns 54 are supplied from the bobbins 14 through a perforated guide plate 16 to maintain each separate from the other prior to delivery to the reed 18 over guide rolls 20 and 22. From the reed 18 the yarn sheet consisting of yarns 54 has an adhesive 28 applied thereto prior to passing over the roll 30, for example, by a reciprocating adhesive spray application 29. From the roll 30 the female fabric is directed to the take-up roll 32 at a sufficient distance from the rolls 28 and 30 to allow the adhesive to set to retain the yarns 54 in the desired substantially parallel position.

The female fabric 10 can be used in many applications where it is desired to use a hook and loop type connection. As an example FIG. 4 shows the fabric 10 adhered to an abrasive coated substrate 34 by an adhesive layer 33 to form the structure 35 with the loops 53 facing the hooks 36 mounted on a rotatable mandrel 38. The structure 35 is placed against the mandrel 38 and the hooks 36 engage the loops 54 to hold the structure 35 on the face of the mandrel 38 so that the abrasive particles 40 can be placed against an area to be abraded or sanded. Obviously, this is only one application of the fabric 10 since it can be used anywhere it is desired to mate two members together using a hook and loop connection.

In one form of the invention a PVA water base emulsion adhesive can be used so it is necessary to heat the roll 30 to aid in heat setting the adhesive sprayed onto the sheet of yarns 54. Other adhesives that can be used with a hot roll 30 are polyethylene or other water based emulsions or solutions of acrylic, styrene butadiene or polyurethane. It is also feasible to use a cold roll 30 along with a hot melt adhesive of polyethylene, polyester, polyamide, polyurethane, etc. which are set by cooling rather than heat.

Other types of adhesive applicators such as a kiss roll can be employed in place of the spray so long as a thin layer of adhesive is applied to the yarn sheet sufficient to hold the yarns 54 in spaced relationship to one another when the adhesive is set.

It should be noted that the yarn sheet passes over the roll 30 and then downward to cause the loops on one side of the yarn sheet to be mashed one against the other to aid in maintaining the spaced relationship of the yarns 54 when the adhesive has set, while the loops on the other side of the yarn sheet are undisturbed.

It can be seen that a simple effective fabric is produced with a minimum number of manufacturing steps which can readily be used as the female fabric or connector in the well-known type of hook and loop connector.

It is contemplated that changes and modifications may be made within the scope of the invention and it is therefore requested that the disclosed invention be limited only by the scope of the claims.

I claim:

1. A method of producing a fabric with loops projecting outwardly therefrom comprising the steps of: manufacturing a plurality of core and effect yarns with loops from the effect projecting therefrom, maintaining adjacent yarns spaced from one another and running the plurality of yarns in a sheet past an adhesive applicator, placing a thin layer of adhesive on said yarn so that said adhesive spans the space between said yarns and some of the loops from one yarn adheres to the loops of the next adjacent yarn setting.

2. The method of claim 1 wherein said effect yarn is supplied at a rate of 100–200% greater than the rate of supply of the core yarn.

3. The method of claim 2 wherein the plurality of yarns in the sheet are fixed substantially parallel to one another.

4. The method of claim 1 wherein the yarn with loops therein are core and effect yarns and the effect yams have been overfed in relation to the core yams during formation of the yarn to cause loops to form therein.

5. The method of claim 4 wherein the plurality of yarns in the sheet are fixed substantially parallel to one another.

* * * * *